United States Patent [19]

John et al.

[11] Patent Number: 4,548,461

[45] Date of Patent: Oct. 22, 1985

[54] CONNECTOR HAVING IMPROVED CONTACT RETAINERS

[75] Inventors: Heinrich R. John, Rodgau; Ulrich B. Münk, Darmstadt, both of Fed. Rep. of Germany

[73] Assignee: AMP Incorporated, Harrisburg, Pa.

[21] Appl. No.: 562,937

[22] Filed: Dec. 19, 1983

[51] Int. Cl.[4] ..... H01R 4/24

[52] U.S. Cl. ..... 339/217 R

[58] Field of Search ..... 339/217 S, 217 R

[56] References Cited

U.S. PATENT DOCUMENTS

| | | | |
|---|---|---|---|
| 3,165,369 | 1/1965 | Maston | 339/217 S |
| 3,808,590 | 4/1974 | Hemmer et al. | 339/217 S |
| 4,397,517 | 8/1983 | Shaffer | 339/217 S |

FOREIGN PATENT DOCUMENTS

| | | | |
|---|---|---|---|
| 2534292 | 2/1976 | Fed. Rep. of Germany | 339/217 S |

*Primary Examiner*—Gil Weidenfeld
*Assistant Examiner*—Gary F. Paumen
*Attorney, Agent, or Firm*—F. W. Raring

[57] ABSTRACT

Electrical connector of the type comprising an insulating housing and contact terminals inserted into the cavities of the housing has a separate contact retainer which is assembled to the housing after the contacts have been inserted. The retainer is latched to the housing after insertion and has retaining fingers each of which engages a contact terminal and prevents its removal from the housing.

4 Claims, 3 Drawing Figures

CONNECTOR HAVING IMPROVED CONTACT RETAINERS

FIELD OF THE INVENTION

This invention relates to multi-contact connectors of the type comprising a housing having terminals inserted into the cavities of the housing. The invention is particularly related to the provision of a separate retaining member for retaining the terminals in the housing.

BACKGROUND OF THE INVENTION

A widely used type of multi-contact electrical connector comprises an insulating housing having a plurality of contact receiving cavities extending through the housing. Electrical contact terminals which have been crimped onto wires are inserted into the cavities from the rear face of the housing and are commonly retained in the housing after insertion by means of lances which are formed integrally with the terminals and which bear against shoulders in the housing.

Under some circumstances, it is desirable to provide an additional retaining means for retaining the terminals in the housing. When the terminals and the housing are both of relatively small size, the lances may not be sufficiently strong to withstand abusive handling and the terminals may be withdrawn from the housing as a result of careless or abusive handling at the time of assembly of the connector to the equipment on which it is being used. A separate retaining means is also desirable if it ensures that the terminals have been fully inserted into the housing during the assembly process; that is, if the separate retainer by virtue of its presence on the housing ensures that the terminals have been fully inserted, it simplifies inspection of the connector and ensures the technician that the connector is functioning properly.

The present invention is directed to the achievement of a multi-contact electrical connector having an improved separate retaining member which is assembled to the housing after insertion of the contact terminals into the cavities of the housing.

An electrical connector in accordance with the invention comprises an insulating housing having a mating face and a rear face which is directed oppositely with respect to the mating face. A contact-receiving cavity extends through the housing from the rear face to the mating face and a contact terminal is contained in the cavity. The terminal has a contact portion which is proximate to the mating face and has a crimp portion which is crimped onto a wire, the crimp portion being between the mating face and the rear face. The wire extends from the crimp portion through the cavity and beyond the rear face. The connector is characterized in that the terminal has a shoulder which faces towards the rear face of the housing and a terminal retainer is provided in the cavity which bears against the shoulder. The terminal retainer is a separate part which was inserted into the cavity from the rear face. The terminal retainer and the housing have interengaged portions which prevent the retainer from movement from the cavity. The retainer extends beside the wire and has a forward stop which is against the shoulder.

In accordance with further embodiments, the housing has a plurality of terminal-receiving cavities which are side-by-side in a row and are in a single plane, each of the cavities having a terminal and a terminal retainer therein. All of the retainers extend from a common support and the housing having a recess extending into the rear face thereof in which the support is positioned. The common support is rectangular and has first and second side edges which extend parallel to the row of cavities, the first side edge being adjacent to the rear face of the housing, the second side edge being spaced inwardly of the rear face, the retainers extending from the second side edge.

THE DRAWING

THE DISCLOSED EMBODIMENT

Figure 1:
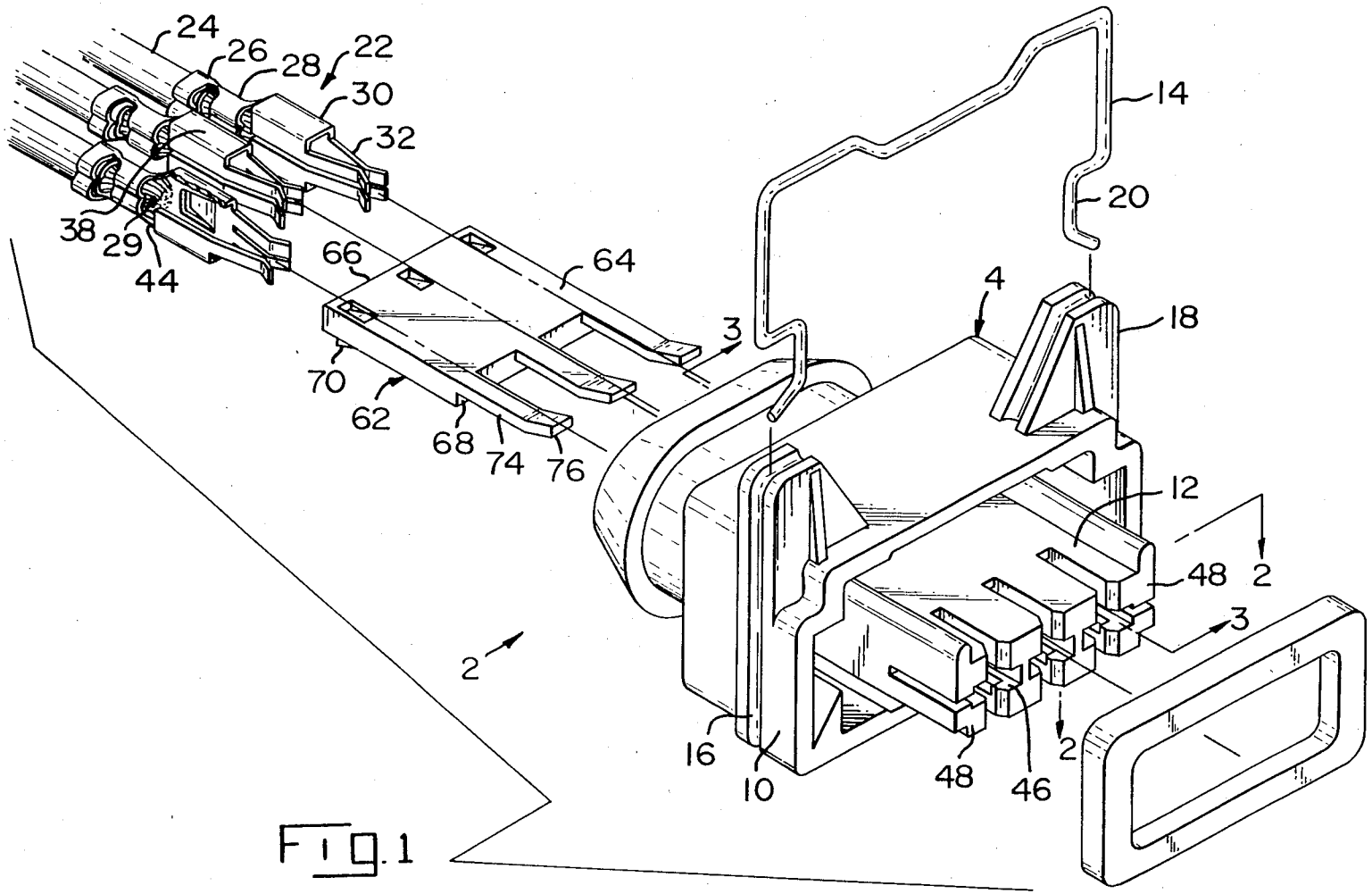
FIG. 1 is a perspective view of a preferred embodiment of the invention showing the terminals and the contact retainer exploded from the connector housing.

A connector 2 in accordance with the invention comprises an insulating housing 4 having a mating face 6 and a rear face 8. The housing may be of any suitable plastic material such as a filled polyester material. A projection 12 extends from the mating face 8 and contains three contact receiving cavities 46 as will be described below. A hood 10 also extends from the mating face 6 in surrounding relationship to the projection 12 so that a complimentary connector is received between the surface of the projection and the interior surface of the hood.

The particular connector shown has a coupling spring 14 mounted in groove 16 on its external surface and supported by integral supports 18. This spring has inwardly formed portions 20 which extend into the interior of the hood and which engage portions of a complimentary connector to maintain the two connectors in coupled relationship.

The contact receiving cavities each contains a contact terminal of the type shown at 22 which has been crimped onto a wire 24 by means of an insulation crimp 26 and a crimp 28 which connects the terminal to the strands 29 of the wire. Each terminal comprises a box-like body 30 having contact spring arms 32 extending from its forward ends for engagement with a complimentary terminal in a complimentary connector.

The box-like body has sidewalls 34, 36, an upper wall 38, and a lower wall 40. A lance 42 is struck from the sidewall 34 and engages a shoulder 51 in the housing when the terminal is inserted into its cavity. This lance and shoulder arrangement is widely used to retain terminals in connector housing and the present invention provides in addition a separate retainer 62 as will be described below for an added margin of safety.

Each of the cavities 46 extends from the outer free end 48 of the projection 12 to the rear face 8 of the housing and has an intermedial portion 50 which receives the rectangular box-like body 30 of the inserted terminal. The forward portion 52 of each cavity receives the spring arms 32 of the terminal and stop 54 which is between the forward and intermedial portions prevents rightward movement of the terminal beyond the position shown in FIG. 3.

Figure 2:
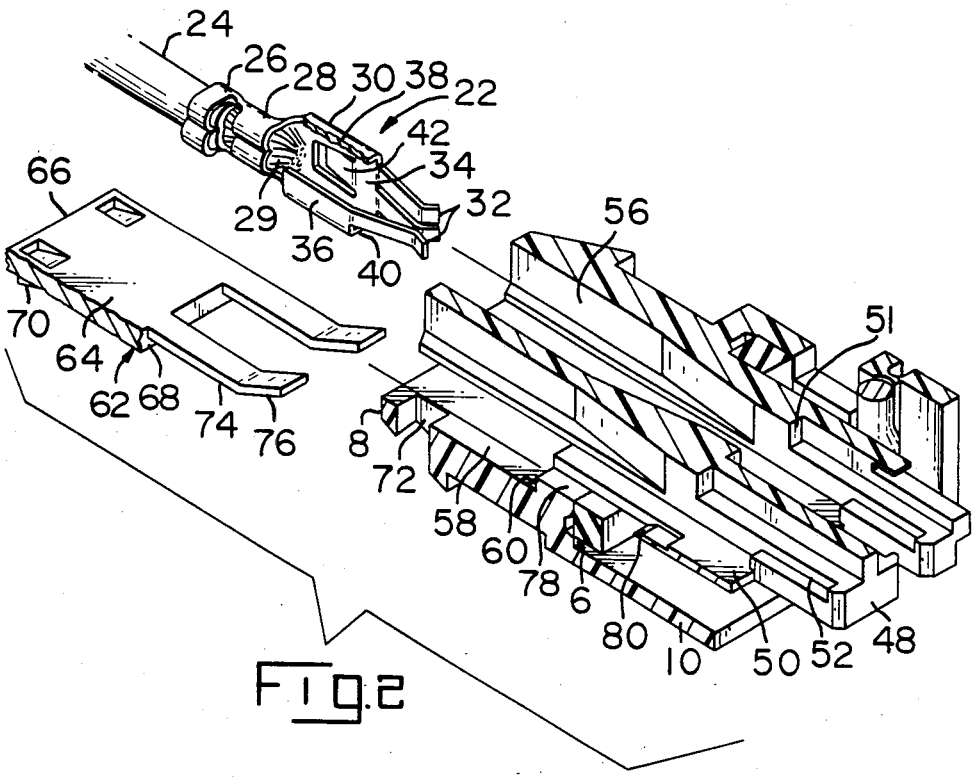
FIG. 2 is a fragmentary sectional view looking in the direction of the arrows 2—2 of FIG. 1.

The rear portion 56 of each cavity is somewhat enlarged and receives the crimps 26, 28 and an end portion 24 of the wire. A recess 58 extends into the rear face and intersects the floors of the cavities 46 as shown in FIG. 2. The inner end of this recess is defined by a rearwardly facing shoulder surface 60 which functions as a stop for the rectangular support portion 64 of a contact retainer 62. The retainer is also of a relatively firm plastic material and has a first edge 66 which is adjacent to the rear face 8 when the retainer is inserted into the recess 58 and a second edge 68 which is against the shoulder 60. The support portion 64 is retained in the recess by means of retaining or latching ears 70 which are struck from the support portion and which are received in openings 72 in the housing.

Spaced apart retaining fingers 74 extend forwardly from the second edge 68 of the support portion and have upwardly turned end portions 76 as viewed in FIG. 2.

Figure 3:
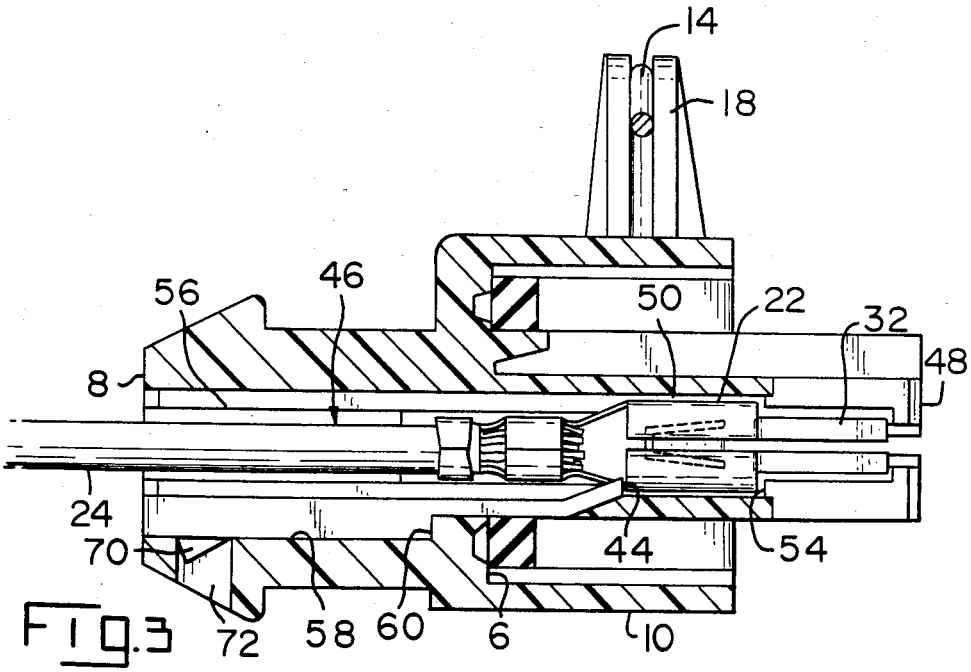
FIG. 3 is a cross-sectional view looking in the direction of the arrows 3—3 of FIG. 1 but showing the exploded parts of FIG. 1 assembled to the connector housing.

Each cavity has a groove adjacent to its intermediate portion which receives the associated finger 74 when the retainer is assembled to the housing and the groove extends to an upwardly inclined ramp 80 as viewed in FIG. 2 which extends beneath the end portion 76 of the finger as shown in FIG. 3.

To assemble the parts of the connector, the terminals are first inserted into the cavities and the retainer 62 is then inserted into the recess 58 until the ears 70 are received in the openings 72. During movement of the retainer into the recess, the ends 76 of the fingers will be guided by the ramp 80 against a rearwardly facing shoulder 44 of the terminal. The shoulder 44 is at the left-hand end, as viewed in FIG. 3, of the body portion of the terminal and the presence of the upwardly turned fingers prevents leftward movement of the terminals from the position of FIG. 3.

It will be apparent from the foregoing description that after the retainer 62 has been assembled to the housing, its presence ensures an inspector that the terminals are fully inserted into their cavities since the retainer cannot be fully inserted unless the ends 76 are against the shoulders 44 of the terminals. The retainer thus provides a valuable inspection aid in addition to greatly increasing the security of the terminals in the housing. It is, in fact, impossible to remove a terminal from the housing by pulling on its associated wire 24; destruction of the terminal will result rather than removal of the terminal.

We claim:

1. An electrical connector of the type comprising an insulating housing having a mating face and a rear face which is directed oppositely with respect to the mating face, a plurality of contact-receiving cavities extending through the housing from the rear face to the mating face, the cavities being in side-by-side parallel relationship in a row, a contact terminal in each cavity, each terminal having a contact portion which is proximate to the mating face and having a crimp portion which is crimped onto a wire, the crimp portion being between the mating face and the rear face, the wire extending from the crimp portion through the cavity and beyond the rear face, the connector being characterized in that:

each of the cavities has a cavity floor, the housing having a recess extending therein from the rear face towards the mating face, the recess intersecting the cavity floors, the recess having an inner end and having a shoulder at the inner end which is directed towards the rear face, a terminal retainer inserted through the rear end of the recess is provided in the housing, the terminal retainer having a common support which extends from the rear end of the housing to the shoulder and which fills the recess, the common support having a plurality of fingers extending therefrom, each of the fingers extending into one of the cavities and having a free end which is against the terminal in the one cavity, each finger being supported by the cavity floor against deflection whereby, the terminals are retained by the fingers in their respectve cavities, and the terminals cannot be inserted into, or removed from, the cavities when the terminal retainer is assembled to the housing.

2. An electrical connector as set forth in claim 1 characterized in that the common support and the housing have releasable interengaging latching means which retain the support in the housing.

3. An electrical connector as set forth in claim 2 characterized in that the free ends of the fingers are against the terminals at locations between the crimp portions and the contact portions of the terminals.

4. An electrical connector as set forth in claim 3 characterized in that each cavity has a groove extending from the recess partially towards the mating face, the fingers being in the grooves.

* * * * *